United States Patent [19]

Boutin et al.

[11] Patent Number: 4,752,331

[45] Date of Patent: Jun. 21, 1988

[54] PROCESS AND APPARATUS FOR PRODUCING METAL ZIRCONIUM BY THE REDUCTION OF ZIRCONIUM TETRACHLORIDE

[75] Inventors: Jean Boutin, St. Martin D'Heres; Pierre Brun, Grenoble; Airy-Pierre Lamaze, Jarrie, all of France

[73] Assignee: Compagnie Europeenne du Zirconium Cezus, Courbevoie, France

[21] Appl. No.: 94,425

[22] Filed: Sep. 9, 1987

[30] Foreign Application Priority Data

Sep. 19, 1986 [FR] France ..... 86 13306

[51] Int. Cl.[4] ..... C22B 59/00

[52] U.S. Cl. ..... 75/84.5; 423/69; 266/905

[58] Field of Search ..... 75/84.5; 423/69; 266/905

[56] References Cited

U.S. PATENT DOCUMENTS

| | | | |
|---|---|---|---|
| 4,242,136 | 12/1980 | Ishizuka | 75/84.5 |
| 4,447,045 | 5/1984 | Kimura et al. | 266/905 |
| 4,508,322 | 4/1985 | Kimura et al. | 75/84.5 |
| 4,668,287 | 5/1987 | Kwon | 75/84.5 |

*Primary Examiner*—Stephen J. Lechert, Jr.

*Attorney, Agent, or Firm*—Dennison, Meserole, Pollack & Scheiner

[57] ABSTRACT

The invention concerns a process for the production of metal Zr by means of molten Mg in a reactor (1) having a hearth plate (3), comprising separating the magnesium chloride formed in the reduction reaction from the metal Zr formed and the magnesium, then cooling, then extracting the sponge cake of metal Zr formed. The process is characterized by separating the magnesium chloride formed by tapping off towards the bottom of the reactor (1) by means of a chimney (6) whose bottom end portion (5) is fixed to an orifice (4) in the hearth plate (3) and whose transverse open top end (7) is above the portion of the metallic mass (Zr, Mg) which borders the chimney (6) at the end of the reduction reaction.

The invention also concerns the corresponding apparatus for the production of metal zirconium.

The invention provides a simplification in the operation of separating the $MgCl_2$ formed and possibly, by virtue of a particular structure of the chimney according to the invention, gives an improvement in the operation of extracting the sponge cake produced.

4 Claims, 1 Drawing Sheet

Figure 1:
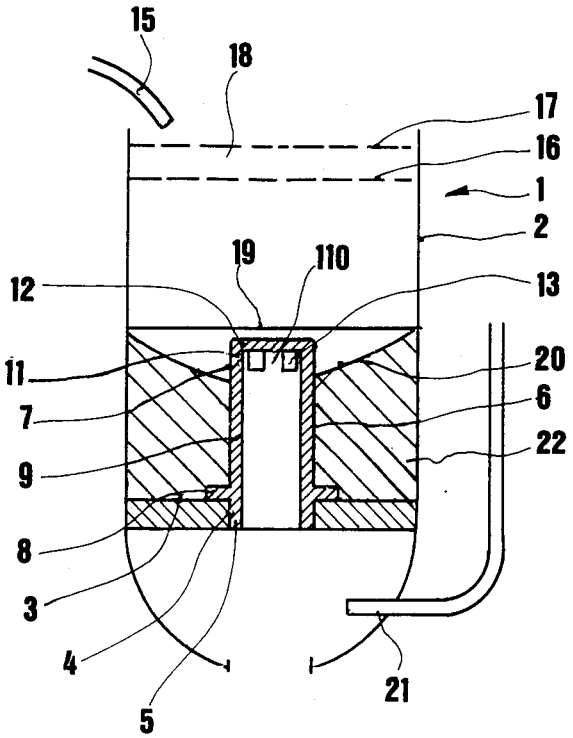

PROCESS AND APPARATUS FOR PRODUCING METAL ZIRCONIUM BY THE REDUCTION OF ZIRCONIUM TETRACHLORIDE

The present invention concerns a process and an apparatus for the production of metal zirconium by the reduction of zirconium tetrachloride by means of molten magnesium in a reactor comprising a hearth plate and more particularly the process for separating the magnesium chloride formed in the reduction reaction from the metal Zr formed and the residual magnesium, and the apparatus for providing for such separation.

Japanese patent No. 78-035888 discloses an apparatus for the production of metal Zr by the reduction of $ZrCl_4$ by means of molten Mg, which comprises on the one hand an internal reaction cylinder which at the end of the reaction contains the reduced sponge of metal Zr, the molten Mg chloride and the metal magnesium not consumed by the reduction reaction, and on the other hand an external cylinder which is disposed in a furnace with a reducing atmosphere. That apparatus further comprises a siphon tube whose internal end is positioned in a pot in the internal cylinder, the pot being provided so that the molten magnesium chloride is retained therein so as to prevent molten Mg from overflowing by way of the siphon tube, the external end being open into the space between the internal cylinder and the external cylinder so that the molten Mg chloride which is produced continuously in the internal cylinder by the reaction of $ZrCl_4$ with the molten Mg which is introduced thereinto in an also continuous manner can be extracted from the internal cylinder by means of the siphon tube when the level of Mg chloride reaches a given level at the other end of the siphon tube. The molten Mg chloride is then extracted from the external cylinder by a pumping system.

That process and apparatus suffer from the disadvantage of using a closed external casing, referred hereinbefore as the "external cylinder", the casing thus collecting molten $MgCl_2$ and necessarily having to be thick as it is used under vacuum and up to around 850° C.

The aim of the process of the invention is to provide for a simplification in which the use of such an external casing is avoided and separation of the molten magnesium chloride from the metal Zr formed and the residual metal Mg is facilitated.

The invention concerns a process for the production of metal zirconium by molten magnesium in a reactor or crucible comprising a hearth plate, the process typically comprising the following steps: separating the magnesium chloride formed in the reduction reaction from the metal Zr formed and the magnesium, then subjecting the metallic mass of Zr and Mg to an evaporation operation under vacuum, then cooling the mass of metal Zr or "sponge cake" and the interior of the reactor (typically to below 150° C.), and then extracting the sponge cake of metal Zr obtained. In accordance with the invention, the magnesium chloride formed is separated by tapping off towards the bottom of the reactor by means of a preferably substantially vertical chimney or stack whose bottom end portion is fixed to an orifice in the hearth plate and whose top opening or tapping-off opening which is usually transverse is slightly above the portion of the metallic mass which borders the chimney at the end of the reduction reaction and at the level of the supernatant layer of magnesium chloride. The top opening of the chimney, which is advantageously horizontal, is preferably surmounted by a cover hood or cap which prevents Zr from dropping into the chimney, the cap being spaced away from the top opening and connected to the chimney by spaced supports which leave between them passages towards the tapping-off opening which are sufficient for the flow of magnesium chloride.

The metallic mass surrounding the chimney is then a pseudo-alloy (Zr, Mg) essentially formed by globules of Zr which are distributed in the metal magnesium, and it is pasty at the temperature of the reduction reaction, that is to say between 750° and 850° C. approximately. A part of the molten Mg chloride which is formed in the reduction reaction in the vapour phase and condensed is in supernatant relationship above the pseudo-alloy and, so that separation of the $MgCl_2$ does not entrain psuedo-alloy and is nonetheless approximately complete, it is appropriate for the tapping-off opening or top end of the chimney or stack to be disposed slightly above the portion of the mass of pseudo-alloy which borders the chimney, at the end of the reduction reaction. That mass of pseudo-alloy itself corresponds to the maximum volume and weight of Zr sponge which is to be obtained at the end of the treatment. The difference in level of the tapping-off opening of the chimney with respect to the maximum level of the pseudo-alloy at that location is typically at least 10 mm and preferably between 10 and 50 mm and still more preferably between 25 and 40 mm, and the internal diameter of the chimney and in particular the tapping-off opening thereof is preferably between 50 and 250 mm in the case of a reactor with a maximum internal diameter of between 1000 and 2000 mm. The magnesium chloride which is drawn off by way of the chimney flows away to the bottom of the crucible where it is picked up by suction.

The tapping-off chimney according to the invention may be provided with lifting means, making it possible to extract the sponge cake by way of the top of the crucible and thus to avoid its returning. The lifting means comprise at least above the top end of the chimney bordering the tapping-off opening thereof a gripping or lifting portion of the asme general shape and to perform the same function as the usual cover cap and the spaced supports thereof, but of mechanical strength and structure which are especially adapted for lifting the assembly (chimney+Zr sponge cake) or possibly the assembly (chimney+Zr sponge cake+hearth plate). The lifting member therefore typically consists of a horizontal member or cap of a thickness which is greater than or equal to 10 mm and which is typically between 10 and 25 mm, connected to the top end of the chimney by an apertured connecting portion so that a lifting means, for example a key or pin, can be introduced through the opening in the connecting portion which itself comprises at least two lugs, the lugs at every level each being of a horizontal cross section of greater than 400 $mm^2$. The lifting means may also comprise one or more relief or projection portions for supporting the sponge cake, the relief portion or portions preferably bearing against the hearth plate so as to consolidate the seating of the chimney during the reduction operation. The chimney must also be of a sufficient mechanical strength for the mass to be lifted.

The optional use of such lifting means and/or provisional connecting means for connecting the chimney to the hearth plate is applied to one or other of the sequences of operations as set out below, which follow the operation of evaporation under vacuum of the metallic mass (Zr, Mg):

(a) After or before the end of the operation of cooling the sponge cake to below 150° C., which is typically carried out in an argon atmosphere, the bottom of the reactor is opened, as well as the top end thereof, and the assembly of the hearth plate and the chimney surrounded by the sponge cake is lifted from below, for example by means of a jack.

After the end of the cooling operation, the sponge cake will be transported with the hearth plate and the chimney for the fragmentation operations, typically involving cutting it into large pieces and then crushing.

To avoid mishaps in the course of those handling operations, it may then be preferable initially to connect the bottom end of the chimney below the hearth plate by provisional fixing means, for example short welds, which fixing means will be easy to break or remove before the operations of cutting and crushing the sponge.

(b) After or before the end of the cooling of the sponge cake to below 150° C., only the top end of the reactor is opened and the chimney surrounded by the sponge cake is lifted from above, by means of the lifting member in the form of a cap on the chimney.

The chimney is then not fixed to the hearth plate and, in addition to its lifting means in cap form, it comprises at least one relief portion for supporting the sponge cake, preferably bearing against the hearth plate so as to consolidate the seating of the chimney during the reduction operation, as already indicated. The stability of the chimney may be also or alternatively enhanced by a small clearance in its fit at its bottom end in the orifice in the hearth plate, of typically less than 0.6 mm over the diameter.

The advantages achieved by those particular features of the chimney are then very substantial from the point of view of the process and the apparatus: it is no longer necessary to open the bottom of the reactor for each extraction operation, the hearth plate remains in position and does not have to be handled and cleaned on each occasion, and optional opening of the bottom of the reactor is then governed only by maintenance problems.

(c) As in (b) above, the chimney is lifted from above, by means of the lifting member in the form of a cap on the top of the chimney, but the bottom end of the chimney is connected below the hearth plate by provisional fixing means which are easy to break or remove but which are sufficiently solid for the lifting operation. The assembly of the hearth plate and the chimney surrounded by the sponge cake is then lifted from above.

The hearth plate is detached as in case (a). Handling the arrangement from above and not opening the bottom of the reactor are still advantages that are retained.

When carrying out the operation of evaporation under vacuum which follows the operation of separating the $MgCl_2$, the presence of the chimney which is typically central provides in all the situations envisaged an increase in the evaporation surface area and the rate of sublimation which gives rise to improved purification of the internal regions close to the chimney, irrespective of the method of heating used. It has been found that it was also possible to achieve medium contents of the usual impurities with a shortened vacuum evaporation operation.

The invention also concerns the apparatus used in that process, comprising a reactor having a hearth plate and means for sublimation of the Zr tetrachloride and means for supplying said gaseous tetrachloride into the chamber of the reactor, means for separation of the magnesium chloride formed from the metal Zr formed and the magnesium, heating means and vacuum generating means, in which apparatus in accordance with the invention the means for separation of the magnesium chloride comprise a chimney whose bottom end portion is fixed to an orifice in the hearth plate and whose top end is slightly above the upper level of the portion of the metallic mass (Zr, Mg) bordering the chimney at the end of the reduction reaction. The particularities and alternative forms of that apparatus are those already described in relation to the process of the invention.

Figure 2:
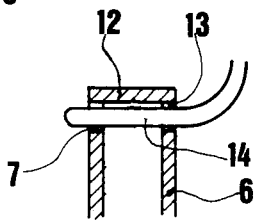
Figure 3:
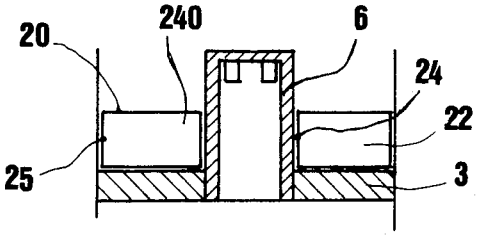
Figure 4:
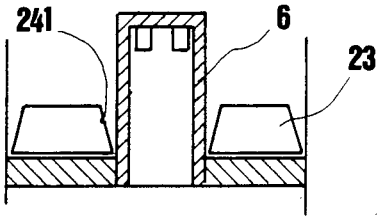

The particular features of the apparatus of the invention will be illustrated by means of the examples and drawings which at the same time will permit the process to be better described. In the drawings:

FIG. 1 is a diagrammatic view in axial section of a reactor according to the invention, FIG. 2 is a view in axial section of the top end of the chimney provided with a cap, FIG. 3 is a diagrammatic view of the hearth plate and the chimney and the pseudo-alloy (Zr+Mg) before evaporation under vacuum, and FIG. 4 shows in the same manner as FIG. 3 the zirconium sponge cake after evaporation under vacuum.

Referring to FIG. 1, shown therein is a reactor 1 with a cylindrical internal side surface 2 and provided with a hearth plate 3 having a central orifice 4 into which is fitted the bottom end portion 5 of a chimney or stack 6 according to the invention; the top transverse open end 7 of the chimney 6 is at a level corresponding to the level of the layer of magnesium chloride which floats above the metallic mass comprising Zr and Mg at the end of the reduction reaction, necessarily above the top of the internal edge of said metallic mass, so that the discharge flow of magnesium chloride does not entrain that metallic mass or "pseudo-alloy" (Zr, Mg). Above its bottom end portion 5 which is thus fitted into the orifice 4 in the hearth plate 3, the chimney 6 comprises a collar 8 which is supported on the hearth plate 3 and which is sufficiently wide to permit the sponge cake to be lifted by the chimney 6, then a cylindrical portion 9 which terminates witih the top open end 7 which is above the metallic mass of Zr and Mg bordering the chimney 6 at the end of the reaction. The open end 7 being surmounted by an apertured connecting portion 11 which is itself surrounded by a cap 12, a lifting means 14 such as a key or rod (see FIG. 2) can be passed into the lateral openings or apertures 13 in the apertured connecting portion 11.

FIG. 1 also diagrammatically represents a conduit or means for the injection of $ZrCl_4$ in vapour from a sublimation apparatus, and the levels 16 and 17 between which there occurs, in the vapour phase, the reaction for the reduction of $ZrCl_4$ by means of Mg, giving rise to small accumulations of reduced Zr, as indicated at 18, which are typically from 5 to 20 μm. The magnesium which initially is disposed above the hearth plate initially reaches the level 19 and the reduced zirconium drops down as the reaction progresses and with the magnesium which is not used for the reduction effect forms an aggregate or pseudo-alloy (Zr, Mg) whose upward surface 20 is curved towards the centre thereof. At the end of the reduction operation the magnesium chloride which has been formed and condensed floats above the metallic mass (Zr, Mg), that is to say above the upward surface 20, and it flows away at the open end 7 of the chimney 6, passing through the lateral openings 13 which are disposed between the open end 7 and the cap 12.

The magnesium chloride is sucked away at the bottom of the reactor 1 by a pipe or conduit 21 which removes it from the reactor 1 by suitable depression means. The means for closing the top of the reactor 1 during the reduction reaction and then during the operation of evaporation under vacuum as well as the top pumping means and the heating means are not illustrated.

FIGS. 3 and 4 show in a simplified fashion the hearth plate 3 provided with the chimney 6 and on the one hand (see FIG. 3) the metallic mass (Zr, Mg), at 22, after reduction and prior to evaporation, and on the other hand (see FIG. 4), by way of comparison, the mass or cake of Zr, as indicated at 23, or the "zirconium sponge", after the operation of evaporation under vacuum. The presence of the chimney 6 creates an internal side evaporation surface 24 in addition to the external side surface 25 and the top surface 20. By virtue of the effect of the evaporation-sublimation of the magnesium, that results in a reduction in the central annular volume 240, the internal side surface 24 which borders it being of a shape 241 in the form of an inverted truncated cone, at the end of the evaporation operation. In fact, due to the effect of evaporation and vapours being given off, the reduction in volume increases in proportion to movement towards the top of the metallic mass in the course of evaporation and then at the end of the evaporation operation as indicated at 23. The additional evaporation surface which is thus due to the chimney 6, which surface evolves from the initial geometry 24 to the final geometry 241, typically represents an increase in the evaporation surface area of 12 to 25%.

PRACTICAL EXAMPLE

The reactor 1 is of steel type AISI 302, of a thickness of 25 mm, with an internal diameter of 1.6 mm in its central cylindrical portion, and an internal height of 3 mm, and at a distance of 350 mm from its bottom it comprises a hearth plate 3 of stainless steel, of a total thickness of 30 mm, having a central orifice 4 which is 200 to 200.5 mm in diameter.

The stainless steel chimney or stack 6 whose bottom end portion 5 is fitted into the orifice 4 is of a total height of 750 mm and it has a central cylindrical internal surface of a diameter of 150 mm. The bottom end portion 5 is 40 mm in height and 199.8 to 200 mm in diameter. It is fixed with respect to the hearth plate 3 by virtue of being fitted therein. The bottom portion 5 is surmounted by a collar or ring 8 of an outside diameter of 240 mm and 10 mm in thickness, which rests on the hearth plate 3 by way of its underneath surface, and then the slightly frustoconical portion 9 of an outside diameter of 200 to 170 mm, terminating with the top open transverse end 7 whose edge is interrupted and surmounted by the apertured connecting portion 11 consisting of four openings 13 and four connecting lugs 110 which are also spaced apart, of a thickness of 10 mm, a width of 40 mm and a height of 40 mm, a cap 12 of a thickness of 20 mm being mounted above the lugs 110.

At the beginning of the reduction operation, the reactor contains 3200 kg of Mg, which amount is related to the 102,000 kg of $ZrCl_4$ to be reduced in that operation.

After that charge of magnesium has been heated under argon to about 750° C., the magnesium is entirely liquid and fills the whole of the bottom of the reactor including the chimney 6 to a level 19 (FIG. 1) which is approximately 1000 mm above the hearth plate 3. Sublimated zirconium tetrachloride vapour, at a temperature of around 400° C., is then introduced into the top of the reactor 1 by way of the tube 15. The reduction reaction begins, with the heating being continued and the temperature rising from 750° to 900° C. approximately, with the flow rate of $ZrCl_4$ vapour being maintained at between 250 and 500 kg/h.

The reaction stops when the 10,200 kg of $ZrCl_4$ has been introduced.

From the traces visible on the wall of the reactor after opening, the top surface 26 of the mass of pseudo-alloy at the end of the reaction is at a level of 670 mm around the chimney and 750 mm along the cylindrical side wall of the reactor. The open top end 7 of the chimney 6 being at 700 mm above the hearth plate 3, that open end 7 is at 30 mm above the portion of the metallic mass (Zr, Mg) which borders the chimney 6, so that the condensed magnesium chloride which is in supernatant relationship almost entirely flows away through the lateral openings 13 and the interior or opening of the open end 7 of the chimney 6. The residue of Mg choride which does not flow away represents less than 100 kg which are in supernatant relationship and 200 to 400 kg trapped in the mass of pseudo-alloy (Zr, Mg).

The magnesium chloride which has flowed away through the chimney 6 has been removed on five to eight occasions by pumping from the bottom of the reactor 1 by means of a conduit 21. Evaporation under vacuum of residual Mg and $MgCl_2$ is effected by heating in the usual manner by way of the side surface of the reactor and maintaining the temperature at between 1000° and 1100° C.

At the end of the vacuum evaporation phase, what is obtained is a mass of 3990 kg of metallic zirconium, which is referred to as "zirconium sponge" because of its cavity-bearing structure, the geometry thereof being as follows: height close to the chimney 6 400 mm, height close to the internal side surface 2 of the reactor 1 600 mm, spacing with respect to the chimney 6 increasing from 10 mm at the level of the collar 8 to 25 mm at the junction of the internal side surface 24 and its top surface 201. The reduction in volume due to the evaporation operation which has caused the elimination of magnesium from the pseudo-alloy (Zr, Mg) and a part of the impurities is particularly marked along the chimney 6 which, besides its function of a means for tapping off the magnesium chloride, thus has a substantial effect on the yield of the evaporation and purification steps. In this case, starting from a metallic mass (Zr, Mg) containing 5 to 10% by weight of $MgCl_2$, there is obtianed a sponge cake 23 containing on average less than 100 ppm of chlorine and in the internal annular portion of the sponge cake which is disposed at less than 100 mm from the chimney 6, mean local contents of less than 50 ppm of $Cl_2$. Without a chimney and under similar evaporation conditions, what is usually obtained is overall mean proportions of 100 to 150 ppm of $Cl_2$ and, in the internal annular portion defined as above, local mean proportions of 150 to 200 ppm of $Cl_2$.

For maximum levels of impurities which are currently accepted, it is thus possible to reduce the evaporation period by 5 to 10% by virtue of using the chimney 6 according to the invention.

After the evaporation operation, the interior of the reactor and the sponge cake 23 are cooled, possibly using one or more fillings of neutral gas to accelerate the cooling action, and the apparatus is brought to atmospheric pressure, preferably below 150° C. The top cover of the reactor 1 being removed, the ingot is then lifted out by way of the top of the chimney 6, using a rod 14 which passes into the side openings 13 between the open end 7 and the cap 12 of the chimney 6, and known lifting means. That method of extracting the Zr sponge mass 23 makes it possible to avoid pollution by rubbing against the inside surface of the reactor, and that is achieved all the more easily since the chimney 6 is central, and it is much more practical than the previously known extraction methods requiring either the bottom of the reactor to be opened or the crucible to be tipped over.

We claim:

1. A process for the production of metal zirconium by the reduction of Zr tetrachloride by molten magnesium in a reactor (1) comprising a hearth plate (3), wherein the magnesium chloride formed in the reduction reaction is separated from the metal Zr formed and the magnesium, then the metallic mass of Zr and Mg is subjected to evaporation under vacuum, then cooling is effected and then the sponge cake of metal zirconium (23) obtaned is extacted, characterised by separating the magnesium chloride formed by tapping off towards the bottom of the reactor (1) by means of a chimney (6) whose bottom end portion (5) is fixed to an orifice (4) in the hearth plate (3) and whose top transverse open end (7) is above the portion of the metallic mass (Zr, Mg) bordering the chimney (6) at the end of the reduction reaction.

2. A process according to claim 1 wherein the bottom end portion (5) of the chimney (6) is fitted into the orifice (4) in the hearth plate (3) and is connected to the hearth plate by provisional fixing means characterised in that after or before the end of cooling of the sponge cake (23), said sponge cake (23) is extracted by lifting from below the assembly of the hearth plate (3) and the chimney (6) surrounded by the sponge cake (23).

3. A process according to claim 1 wherein the bottom end portion (5) of the chimney (6) is fitted into the orifice (4) in the hearth plate (3) and above its transverse open top end (7) said chimney (6) comprises a lifting portion formed by a cap (12) connected to said end (7) by an apertured connecting means (11) and, above its bottom end portion (5), said chimney has at least one relief portion (8) for supporting the sponge cake (23), characterised in that the sponge cake (23) is extracted by lifting from above the assembly of the sponge cake (23) and the chimney (6), by means of the cap (12) on said chimney.

4. A process according to claim 1 wherein the bottom end portion (5) of the chimney (6) is fitted into the orifice (4) in the hearth plate (3) and is connected to the hearth plate (3) by provisional fixing means and the chimney (6) comprises above its transverse open top end (7) a lifting portion formed by a cap (12) connected to said end (7) by an apertured connecting means (11) characterised in that the sponge cake (23) is extracted by lifting from above the assembly of the hearth plate (3), the sponge cake (23) and the chimney (6), by means of the cap (12) of said chimney (6).

* * * * *